United States Patent [19]

Nakahata

[11] 4,402,591

[45] Sep. 6, 1983

[54] ELECTROPHOTOGRAPHIC APPARATUS

[75] Inventor: Kimio Nakahata, Kawasaki, Japan

[73] Assignee: Canon Kabushiki Kaisha, Tokyo, Japan

[21] Appl. No.: 191,030

[22] Filed: Sep. 26, 1980

[30] Foreign Application Priority Data

| | | | |
|---|---|---|---|
| Sep. 29, 1979 | [JP] | Japan | 54-126184 |
| Oct. 1, 1979 | [JP] | Japan | 54-127196 |
| Oct. 1, 1979 | [JP] | Japan | 54-127197 |
| Oct. 9, 1979 | [JP] | Japan | 54-130267 |
| Oct. 9, 1979 | [JP] | Japan | 54-130268 |
| Oct. 11, 1979 | [JP] | Japan | 54-131129 |
| Oct. 22, 1979 | [JP] | Japan | 54-136912 |
| Apr. 14, 1980 | [JP] | Japan | 55-48912 |
| Apr. 18, 1980 | [JP] | Japan | 55-51423 |

[51] Int. Cl.[3] ..... G03G 15/14; G03G 15/16

[52] U.S. Cl. ..... 355/3 TR; 355/3 CH; 355/14 TR

[58] Field of Search ..... 355/3 R, 3 TR, 3 CH, 355/14 CH, 14 TR

[56] References Cited

U.S. PATENT DOCUMENTS

| | | | |
|---|---|---|---|
| 3,457,405 | 7/1969 | Del Vecchio et al. | 355/3 CH X |
| 3,496,351 | 2/1970 | Cunningham | 355/3 CH X |
| 3,788,739 | 1/1974 | Coriale | 355/3 R X |
| 4,039,257 | 8/1977 | Connolly | 355/14 TR X |
| 4,077,709 | 3/1978 | Borostyan et al. | 355/3 TR |
| 4,110,031 | 8/1978 | Ebi et al. | 355/3 CH X |
| 4,141,648 | 2/1979 | Gaitten et al. | 355/3 CH |
| 4,166,690 | 9/1979 | Bacon et al. | 355/3 CH |
| 4,190,348 | 2/1980 | Friday | 355/3 TR |

*Primary Examiner*—Fred L. Braun

*Attorney, Agent, or Firm*—Fitzpatrick, Cella, Harper & Scinto

[57] ABSTRACT

An electrophotographic apparatus in which a pre-transfer corona discharger is provided between a developing device and a transfer charger, an AC is applied to the discharge electrode of the discharger, a grid is provided in the opening portion of the discharger, a potential between the dark portion potential and the light portion potential on a photosensitive member is applied as a bias potential, corona discharge of the same polarity as the charge polarity of toner is imparted to toner adhering the dark portion having a potential greater than the grid bias potential to increase the transfer efficiency, and corona discharge of the opposite polarity to the polarity of toner is imparted to toner in the light portion to change the charge polarity of toner and thereby prevent fog.

22 Claims, 29 Drawing Figures

ELECTROPHOTOGRAPHIC APPARATUS

BACKGROUND OF THE INVENTION

1. Field of the Invention

This invention relates to an electrophotographic apparatus having a pre-transfer corona discharger provided between a developing device and a transfer charger to prevent fog toner adhering to the image light portion of an electrophotographic photosensitive member from being transferred to transfer medium. More particularly, it relates to an electrophotographic apparatus in which the charge polarity of toner adhering to the image dark portion is not varied but rather the amount of charge thereof is increased and moreover, only the charge polarity of toner adhering to the image light portion is varied to thereby prevent such fog toner from being transferred to transfer medium.

2. Description of the Prior Art

As an example of the prior art, a method and means for preventing transfer of fog toner by applying a very weak corona discharge of the opposite polarity to developing toner to a developed photosensitive member prior to image transfer are disclosed in U.S. Pat. No. 3,444,369. Briefly, the content of this patent is as follows.

For example, a selenium photosensitive member is used as the photosensitive member, and a dark portion latent image potential +800 V and a light portion latent image potential +200 V are formed on the surface of the photosensitive member by the Carlson method. When uniform corona discharge is effected on the photosensitive member having a latent image so formed thereon, by the use of a corotron, there occurs a difference in increased charge amount of corona discharge between the dark portion and the light portion. When the polarity of the corotron is ⊕, in the dark portion of the photosensitive member, the charge amount imparted by the corotron leaks through the photosensitive member layer to the substrate of the photosensitive member as a charge amount greater than that allowed for the photosensitive member and the potential of the photosensitive member surface is maintained at +800 V. On the other hand, in the light portion of the photosensitive member, the surface potential is gradually increased by receiving ⊕ charge from the corotron.

When compared in terms of the charge amount imparted to the photosensitive member surface per unit of time, in the dark portion of the photosensitive member, the electric field by its surface potential 800 V suppresses the ⊕ corona discharge of the corotron more strongly than the electric field by the surface potential 200 V of the light portion of the photosensitive member, with a result that the charge amount imparted to the dark portion of the photosensitive member becomes smaller and the charge amount imparted to the light portion of the photosensitive member becomes greater. When there is toner adhering to the photosensitive member surface, the polarity of the toner adhering to the light portion is readier to vary. Therefore, the ⊖ toner in the light portion readily changes to the ⊕ polarity and therafter, when transfer corona of the ⊕ polarity is applied to the back side of transfer medium, the toner in the dark portion is transferred to the transfer medium, whereas the toner in the light portion is not transferred to the transfer medium, thus providing a copy image free of fog.

Now, where the fog preventing means described in the aforementioned U.S. Pat. No. 3,444,369 is incorporated in a commercially available machine, irregularity is liable to occur to the transfer of the toner in the image dark portion and, when the environment in which the machine is installed has changed, there is a disadvantage that the ability to prevent the transfer of the toner adhering to the image light portion is reduced.

FIG. 1 of the accompanying drawings illustrates the reason therefor. Designated by 1 is a selenium photosensitive member. D denotes the image dark portion, and the surface potential of the photosensitive member is +800 V. Designated by 2 is ⊖ toner adhering to the image dark portion, and the surface potential of the photosensitive member after the adherence of toner thereto is −700 V. L denotes the image light portion, and the surface potential of the photosensitive member is +200 V. Reference numeral 2 designates ⊖ toner adhering to the image light portion, and reference numeral 3 denotes non-charged toner which electrostatically or mechanically adheres. In the light portion, the surface potential of the photosensitive member hardly varies after the adherence of toner thereto. A corotron is provided on the photosensitive member, and reference numeral 4 designates the discharge wire of the corotron. The spacing between the photosensitive member 1 and the corona wire 4 is 13 mm.

When, for example, a voltage of +6 KV is applied to the corotron, there occur the following electric fields between the toner surface and the corona wire:

In the dark portion:

$$E_D = \frac{E_O - E_P + E_T}{13} = \frac{6000 - 800 + (800 - 700)}{13} \approx 408 \text{ V/mm}$$

In the light portion:

$$E_L = \frac{6000 - 200}{13} \approx 446 \text{ V/mm}$$

where $E_O$ represents the electric field by the corotron, $E_P$ represents the electric field by the photosensitive member, and $E_T$ represents the electric field by the toner.

The corona ions emitted from the corotron move through said electric fields and charge the adhering toner. As will be readily seen, the electric field $E_L$ in said light portion is substantially equal to the electric field $E_D$ in said dark portion. Therefore, according to the method of the prior art, it is very difficult to change the polarity of only the toner adhering to the light portion and not to change the polarity of the toner adhering to the dark portion. That is, part of the toner adhering to the dark portion is changed to the ⊕ polarity, and then when transfer corona is applied, the toner changed to the ⊕ polarity is not transferred, thus causing irregularity of the image.

When, for example, +4 KV is applied to the corotron, there occur the following electric fields between the toner surface and the corona wire:

In the dark portion:

$$E_D = \frac{4000 - 800 + (800 - 700)}{13} \approx 254 \text{ V/mm}$$

In the light portion:

$$E_L = \frac{4000 - 200}{13} \approx 292 \text{ V/mm}$$

The electric field in the direction of the dark portion is below the corona discharge starting electric field and therefore, the corona current generated in this direction is small. Thus, it is very rare that toner adheres to the dark portion by the corona generated by the corotron and the polarity of the toner is changed. On the other hand, ⊕ corona is imparted to the toner adhering to the light portion, thereby enabling fog to be prevented.

However, since the intensity of the electric field $E_L$ is small, the movement speed of the corona moving from the discharge electrode to the photosensitive member is slow and this leads to a disadvantage that too much time is required to impart sufficient ⊕ corona to prevent fog. Also, since the corotron is used in the vicinity of the corona starting voltage, the generation of corona is too much suppressed when temperature and humidity change, and this leads to a disadvantage that prevention of fog is not sufficiently effected.

SUMMARY OF THE INVENTION

It is an object of the present invention to prevent the above-noted disadvantages and to provide an electrophotographic apparatus having an improved pre-transfer corona discharger for obtaining images free of transfer irregularity and fog.

It is another object of the present invention to provide an electrophotographic apparatus in which the polarity of the toner adhering to the image dark portion is not changed but only the polarity of the toner adhering to the image light portion is changed, thereby preventing such fog toner from being transferred to transfer medium.

It is still another object of the present invention to provide an electrophotographic apparatus in which the transfer efficiency of the image portion toner is improved while suppressing the transfer of the fog toner on an image bearing member, thereby enabling copy images of high quality to be obtained.

It is yet still another object of the present invention to provide an electrophotographic apparatus in which the charge amount of the toner adhering to the image dark portion is increased to improve the transfer efficiency and the charge polarity of the toner adhering to the image light portion is changed to prevent such fog toner from being transferred to transfer medium.

It is a further object of the present invention to provide an electrophotographic apparatus in which only the image area having a density lower than a specific density can be reproduced or erased.

It is still a further object of the present invention to provide an electrophotographic apparatus in which the grid bias voltage of the pre-transfer corona discharger is varied in accordance with the frequency of use of the image bearing member or developer to thereby prevent fog of the image.

It is yet still a further object of the present invention to provide an electrophotographic apparatus in which, while measuring the variation in the light portion latent image potential of the image bearing member, a voltage of the measured value plus a predetermined bias value is applied to the grid of the pre-transfer corona discharger to ensure obtainment of images free of fog.

It is a further object of the present invention to provide an electrophotographic apparatus in which the grid bias voltage of the pre-transfer corona discharger is varied in accordance with the adjusted position of image adjusting means to thereby prevent fog of copy images.

The present invention which achieves these objects is an electrophotographic apparatus having an image bearing member capable of bearing an electrostatic latent image on the surface thereof, latent image formation means for forming an electrostatic image on the image bearing member, developing means for developing the electrostatic latent image, means for transferring the developed image to a transfer medium, and a pre-transfer corona discharger device provided in an area from a developing station to a transfer station and having a grid in the discharge opening portion thereof which faces the image beaing member, a potential between the dark portion potential and the light portion potential of the electrostatic latent image on the image bearing member being applied as a bias potential to the grid.

The above and other objects and features of the present invention will become more fully apparent from the following detailed description taken in conjunction with the accompanying drawings.

DESCRIPTION OF THE PREFERRED EMBODIMENTS

Figure 2:
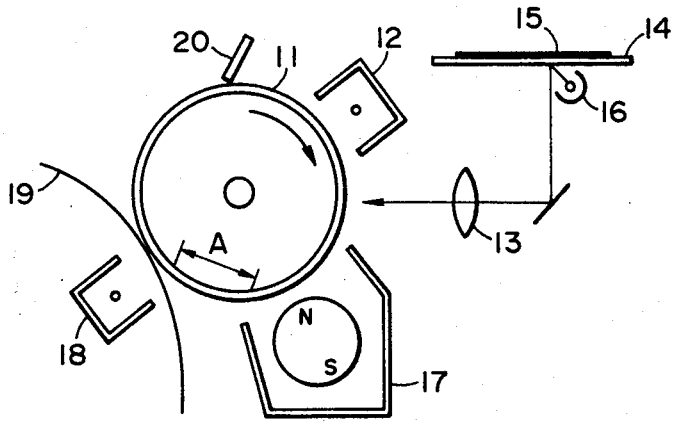
FIG. 2 is a schematic view of an electrophotographic copying machine to which the present invention is applicable.

Embodiments of the present invention will hereinafter be described with reference to the drawings. FIG. 2 is a schematic view of an electrophotographic copying apparatus to which the present invention is applicable and to which the electrophotographic method called the Carlson process has been applied. In FIG. 2, reference numeral 11 designates a photosensitive drum, reference numeral 12 denotes a corona charger for uniformly charging the photosensitive drum, and reference numerals 13 designates an optical system for causing the reflected light of an original 15 placed on an original carriage glass 14 and illuminated by an exposure lamp 16 to be imaged on the photosensitive drum. Reference numeral 17 denotes a developing device, reference numeral 18 designates a transfer charger for transferring the visualized image to a transfer medium 19, and reference numeral 20 denotes cleaning means.

In the electrophotographic apparatus of such construction, the photosensitive drum comprising an Al cylinder having amorphous selenium such as Se or SeTe evaporated thereon is uniformly charged to the positive polarity to activate the photosensitive drum, and then the photosensitive drum is exposed to the light-and-dark pattern of the original image to thereby form a light and dark electrostatic latent image pattern on the photosensitive drum. Usually, on the surface of the photosensitive drum, a surface potential of VL=+200 V is obtained as a light portion latent image and a surface potential of VD=+800 V is obtained as a dark portion latent image. Subsequently, the photosensitive drum is subjected to the developing step, whereby the latent image thereon is developed into a visible image by a developer consisting of a mixture to toner comprising thermoplastic resin powder of the negative polarity having a particle diameter of 3–15$\mu$ and magnetic carrier. After the development, the photosensitive drum surface potential in the light portions remains almost unchanged and exhibits VL=+200 V, whereas the surface potential in the dark portion is somewhat reduced to VD=+700 V under the influence of the negative charge of the toner. The toner electrostatically attracted to the latent image on the photosensitive drum by the development is transferred onto a transfer medium by applying transfer corona discharge opposite in polarity to the toner from the back side of the transfer medium.

Figure 1:
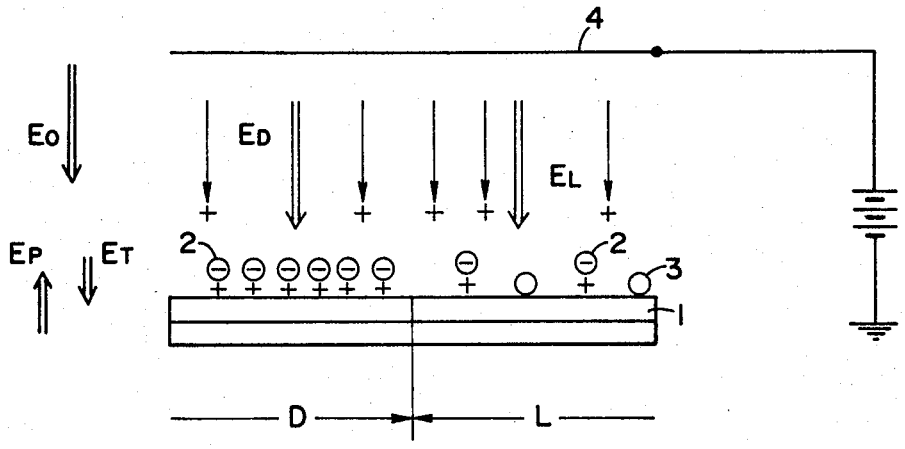
FIG. 1 PRIOR ART
FIG. 1 is an illustration showing the reason for the disadvantages peculiar to the apparatus of the prior art.
Figure 3:
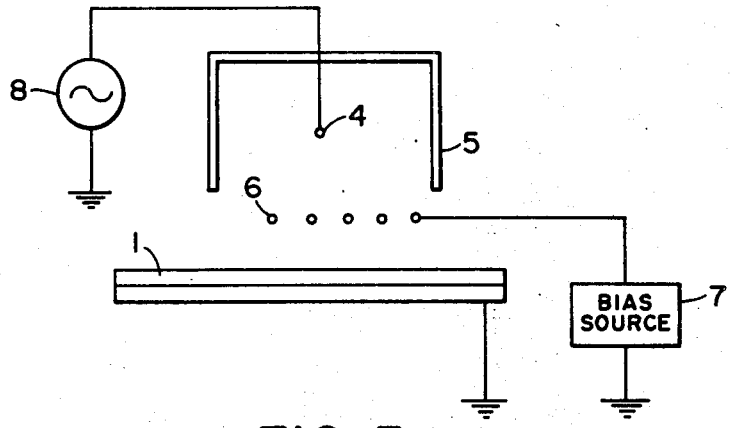
FIG. 3 illustrates the construction of the pretransfer corona discharger according to an embodiment of the present invention.

FIG. 3 illustrates the construction of the pre-transfer corona discharger device according to an embodiment of the present invention. This pre-transfer corona discharger device is disposed in opposed relationship with the photosensitive drum at an area indicated by A in FIG. 2, namely, the area from the developing station to the transfer station. In FIG. 3, members identical to those of FIG. 1 are given identical reference characters. Designated by 1 is the photosensitive member. On the surface thereof, a latent image having a dark portion surface potential of VD=+800 V and a light portion surface potential VL=+200 V is formed. After the development, the surface potentials become +700 V and +200 V, respectively. Designated by 5 is a discharger shield, and denoted by 4 is a discharge electrode, to which an AC high voltage of about 6 KV is applied by a power source 8. In the opening portion of the discharger which is adjacent to the photosensitive medium, tungsten wires of $\phi 60\mu$–$\phi 100\mu$ as a control grid 6 are provided at an interval of 0.5–2 mm and spaced apart from the surface of the photosensitive medium by about 1 mm, and these are connected to a bias source 7.

As the bias voltage VB, a voltage between the light portion potential VL and the dark portion potential VD of the photosensitive medium after the development is chosen. This is for forming a promoting electric field and a suppressing electric field of corona ion between the surface potential of the photosensitive member and the control grid and as a result, the dark portion toner is charged more to the negative polarity to improve the image transfer characteristic and only the toner adhering to the non-imaged light portion is changed to the opposite polarity to prevent fog. Moreover, a voltage exceeding the corona starting voltage can be applied to the discharge electrode, thus preventing the disadvantage peculiar to the prior art that the effect of fog prevention is decreased by changes in the environmental conditions such as temperature, humidity, etc.

Figure 4:
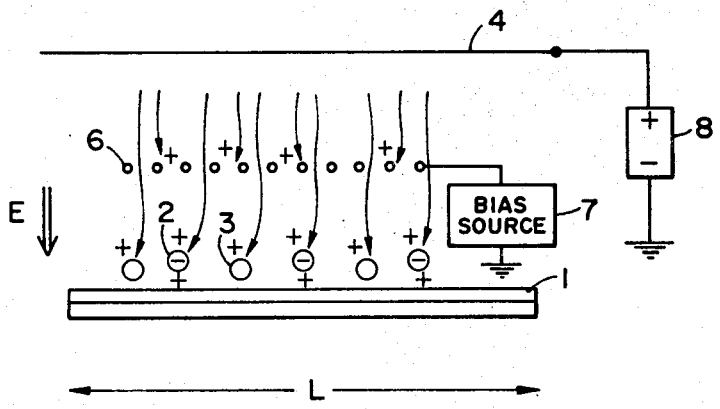
FIGS. 4 to 7 illustrate the action of the pretransfer corona discharger of the present invention.

FIG. 4 shows the condition during the positive corona discharge of the light portion L. A bias VB of about +400 V is applied to the control grid. The positive corona ions generated at the discharge electrode 4 reach the neighborhood of the control grid 6, whereafter they reach the photosensitive member surface along a promoting electric field E=VB−VL=200 V/mm formed between the control grid 6 and the photosensitive member 1 and change the fog toner 2, 3 in the image light portion to the positive polarity. This charging is continued until the surface potential of the photosensitive member becomes +400 V, and the fog toner is sufficiently changed to the positive polarity.

Figure 5:
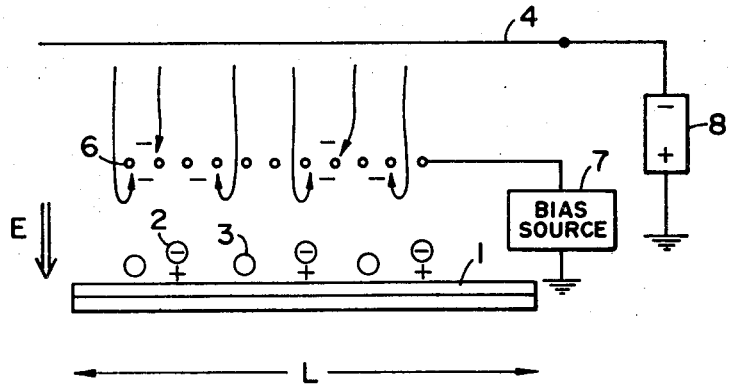

FIG. 5 shows the condition during the negative corona discharge of the light portion L. The negative corona ions generated at the discharge electrode 4 reach the neighborhood of the control grid 6, but cannot reach the photosensitive member due to a suppressing electric field E=200 V/mm formed between the control grid 6 and the photosensitive member 1 and are caught by the control grid. Thus, the toner adhering to the image light portion is never charged to the negative polarity.

Figure 6:
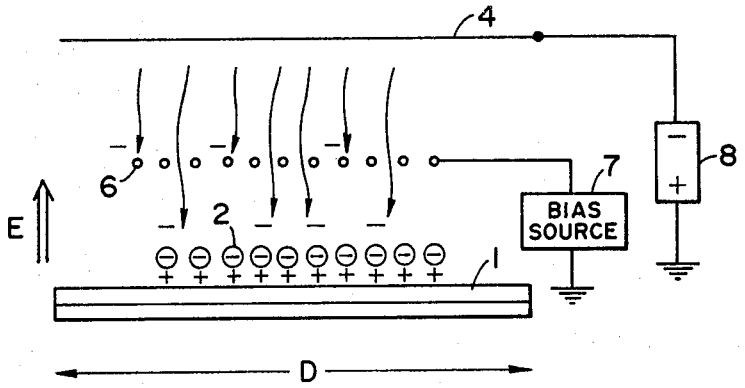

FIG. 6 shows the condition during the negative corona discharge of the dark portion D. A bias of about +400 V is applied to the control grid. The negative corona ions generated at the discharge electrode 4 reach the neighborhood of the control grid 6, whereafter they reach the surface of the photosensitive member along a promoting electric field E=VD−VB=300 V/mm formed between the control grid 6 and the photosensitive member 1, thereby charging the toner in the image dark portion more to the negative polarity. As a result, the toner in the dark portion is sufficiently charged to the negative polarity to improve the image transfer efficiency.

Figure 7:
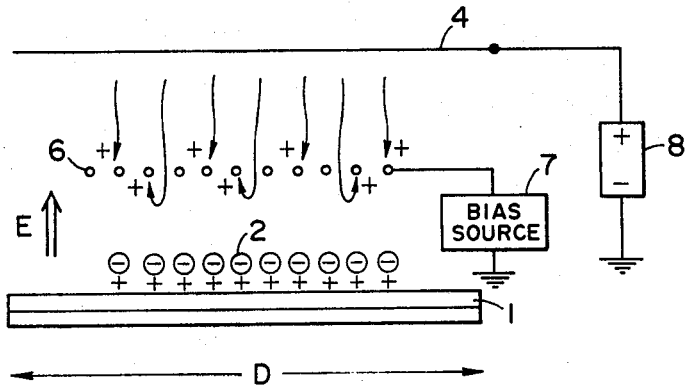

FIG. 7 shows the conditions during the positive corona discharge of the dark portion D. The positive corona ions generated at the discharge electrode 4 reach the neighborhood of the control grid 6, but cannot reach the photosensitive member due to a suppressing electric field 300 V/mm formed between the control grid 6 and the photosensitive member 1 and are caught by the control grid. Thus, the toner adhering to the image dark portion is never changed to the positive polarity.

In the manner described above, the toner in the image dark portion can be charged to a stronger negative polarity while, at the same time, the toner in the image light portion can be changed to the opposite polarity and thus, it becomes possible to obtain a copy image of high image density which is free of fog and transfer irregularity.

Figure 8:
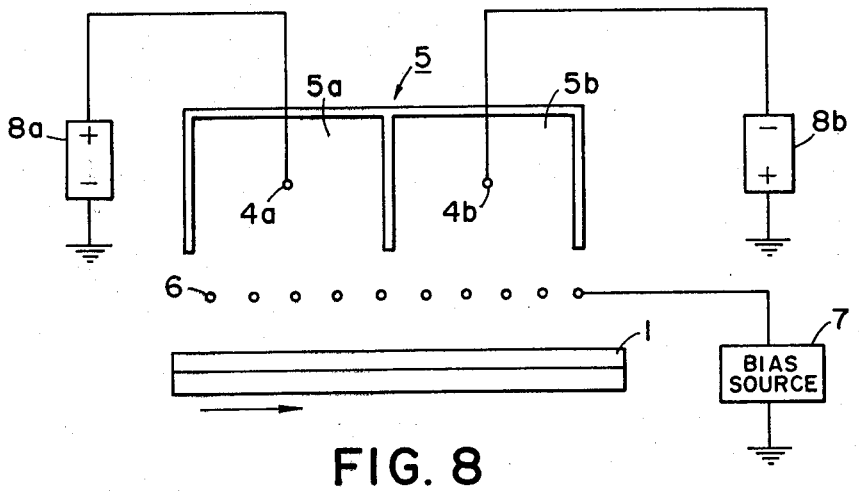
FIGS. 8 to 10 illustrate the constructions of further pre-transfer corona dischargers according to the present invention.

FIG. 8 is a schematic view of the pre-transfer corona discharger device according to another embodiment of the the present invention. This device is provided with a pre-transfer corona discharger having applied thereto a high voltage of the same polarity as the toner polarity, instead of applying AC to the corona discharge electrode of the pre-transfer corona discharger device, a pre-transfer corona discharger having applied thereto a high voltage of the opposite polarity to the toner polarity, and a control grid disposed in the opening portions of the two dischargers and in proximity to the photosensitive member, and a bias voltage between the potential VD of the dark portion of the photosensitive member after developed and the potential VL of the light portion of the photosensitive member after developed is applied to the control grid.

In FIG. 8, members identical to those of FIG. 3 are given identical reference characters. Designated by 1 is the photosensitive member. On the surface thereof, a latent image having a dark portion surface potential VD=+800 V and a light portion surface potential VL=+200 V is formed. The surface potentials after the development are +700 V and +200 V, respectively. The pre-transfer corona discharger 5 provided in the area from the developing station to the transfer station is divided into a plus (+) corona discharge portion 5*a* and a minus (−) corona discharge portion 5*b*, and high voltages of +6 KV and −6 KV are applied to respective corona discharge electrodes 4*a* and 4*b* by high voltage power sources 8*a* and 8*b*, respectively. The photosensitive member 1 is movable in the direction of arrow.

In the opening portions of the dischargers which face the photosensitive member, tungsten wires of $\phi 60\mu$–$\phi 100\mu$ as a control grid are disposed at an interval of 0.5–2 mm and spaced apart from the surface of the photosensitive member by about 1 mm, and these are connected to a bias source 7.

As the bias voltage, a voltage between the light portion potential and the dark portion potential of the photosensitive member after developed is chosen. The reason therefor is the same as that set forth in connection with the application of AC in FIG. 3.

The condition of the photosensitive member surface during the positive corona discharge by the plus (+) corona discharge portion 5*a* is shown in FIGS. 4 and 7, and the condition of the photosensitive member surface during the negative corona discharge by the minus (−) corona discharge portion 5*b* is shown in FIGS. 5 and 6.

With such construction, as in the case of the application of AC of FIG. 3, the toner in the image dark portion can be charged to a stronger negative polarity while, at the same time, the toner in the image light portion can be changed to the opposite polarity and thus, it becomes possible to obtain a copy image of high density which is free of fog and transfer irregularity.

Figure 9:
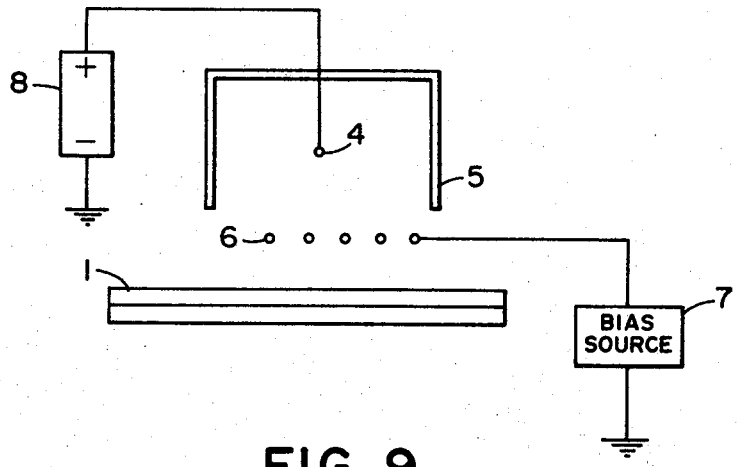

Incidentally, the following construction is also possible to prevent fog toner in the image light portion. FIG. 9 illustrates the construction of the pre-transfer corona discharger device according to another embodiment of the present invention. In FIG. 9, members identical to those of FIG. 3 are given identical reference characters. A high voltage of about +6 KV opposite in polarity to the toner is applied from a power source 8 to the discharge electrode 4. The other conditions are similar to the case of FIG. 3.

As the bias voltage to the grid 6, a voltage between the light portion potential and the dark portion potential of the photosensitive member after developed is chosen. This is for forming a promoting electric field and a suppressing electric field of corona ion between the surface potential of the photosensitive member and the control grid and as a result, only the toner adhering to the non-image light portion is changed to the opposite polarity to thereby achieve the prevention of fog. Moreover, a voltage exceeding the corona starting voltage can be applied to the discharge electrode, thereby preventing the disadvantage peculiar to the prior art that the effect of fog prevention is decreased by changes in environmental conditions such as temperature, humidity, etc.

The condition of the light portion of the photosensitive member by the pre-transfer corona discharger device of this embodiment is shown in FIG. 4. By this, the fog toner is sufficiently changed to the positive polarity. The condition of the dark portion of the photosensitive member is shown in FIG. 7. In this case, the polarity of the toner adhering to the image dark portion is never changed to the positive.

In the manner described above, the polarity of only the toner in the image light portion can be changed to the opposite polarity without marring the polarity of the toner in the image dark portion and thus, it becomes possible to obtain a copy image which is free of fog and transfer irregularity.

Figure 10:
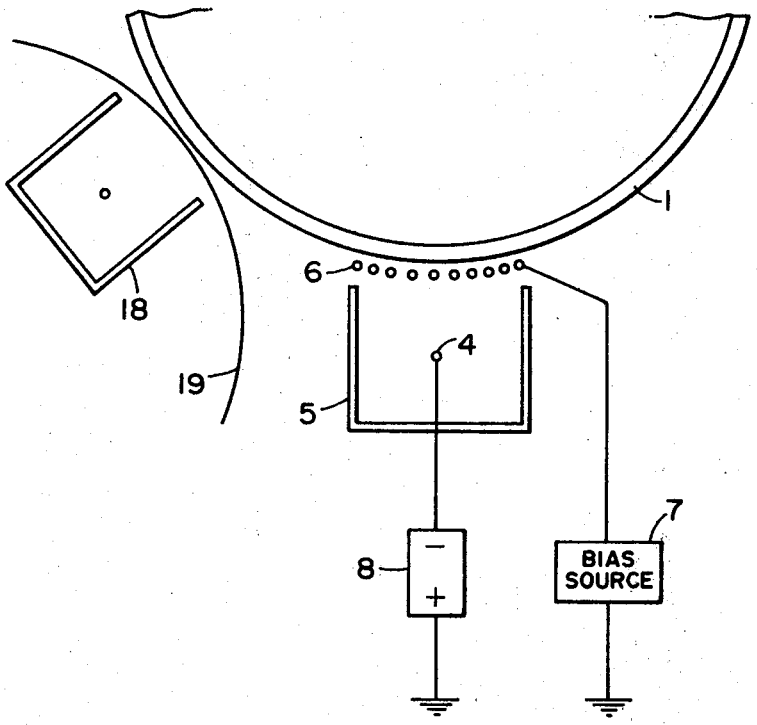

The following construction may also be adopted to charge the toner in the dark portion of the photosensitive member more strongly and thereby improve the transfer efficiency and to form a suppressing electric field of corona discharge between the light portion of the photosensitive member and the control grid and thereby prevent the fog toner from being charged. FIG. 10 illustrates the construction of the pre-transfer corona discharger device according to still another embodiment of the present invention. In FIG. 10, members identical to those of FIG. 3 are given identical reference characters. A high voltage of about −6 KV of the same polarity as that of the toner is applied from the power source 8 to the discharge electrode 4. The other conditions are similar to the case of FIG. 3.

As the bias voltage to the grid 6, a voltage between the light portion potential VL and the dark portion potential VD of the photosensitive drum after developed is chosen. This is for forming a promoting electric field and a suppressing electric field of corona ion between the surface potential of the photosensitive drum and the control grid and as a result, the dark portion toner is charged more to the negative polarity to improve the transfer efficiency. When the light portion potential of the photosensitive drum after developed is VL=+200 V and the dark portion potential thereof is VD=+700 V, +400 V, for example, is applied to the control grid. Thereupon, a promoting electric field of the pretransfer corona discharge of 300 V/mm is formed between the dark portion of the photosensitive drum and the control grid, and a suppressing electric field of 200 V/mm is formed between the light portion and the control grid.

The condition of the light portion of the photosensitive member by the pre-transfer corona discharger device of this embodiment is shown in FIG. 5. By this, the fog toner 2, 3 adhering to the image light portion is never charged to the negative polarity. The condition of the dark portion of the photosensitive member is shown in FIG. 6. As a result, the dark portion toner is sufficiently charged to the negative polarity to improve the transfer efficiency.

In the manner described above, it becomes possible to render the polarity of the toner in the image dark portion to a stronger negative polarity and thus, the transfer efficiency is improved to enable a copy image free of transfer irregularity to be obtained. Further, the image transfer is never affected by the environment as in the conventional pre-transfer corona discharger.

Incidentally, in a case where characters written on white paper are copied, there is usually no problem, whereas in a case where characters or pictures depicted on colored paper are copied, the entire background of the characters on the copy sometimes appears fogged to render the characters illegible. In such latter case, it has usually been practised to increase the amount of exposure to the photosensitive member by means of an exposure amount adjusting dial and remove the charge in the low density portion such as the background or the like. However, if the amount of exposure is increased, the density of the character portion is also decreased correspondingly, resulting only a copy image of low contrast.

According to an embodiment of the present invention which will hereinafter be described, the image portion having a density lower than a desired density can be erased, thus overcoming the above-noted disadvantage.

Figure 11:
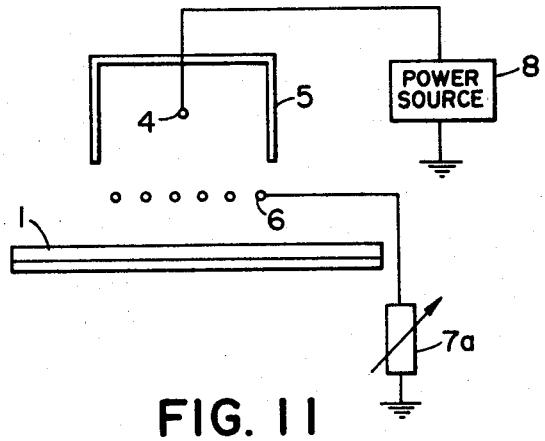
FIGS. 11 to 13 illustrate the constructions of pre-transfer corona dischargers having a variable grid bias source.
Figure 12:
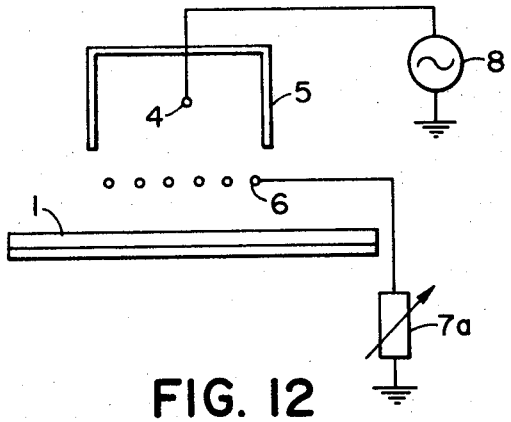
Figure 13:
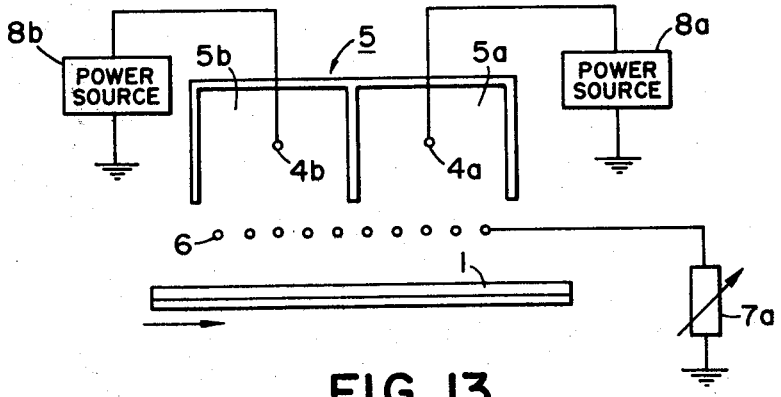

FIGS. 11, 12 and 13 illustrate the constructions of the pre-transfer corona discharger devices in this embodiment. In FIG. 11, the discharge electrode 4 is connected to a high voltage power source 8 of about 6 KV opposite in polarity to the toner. In the device of FIG. 12, an AC high voltage of about 6 KV is applied from a power source 8 to the discharge electrode 4. In FIG. 13, there is shown a pre-transfer corona discharger device 5 having a discharging portion 5*a* connected to a high voltage power source 8*a* opposite in polarity to the toner, and a discharging portion 5*b* having applied thereto a high voltage of the same polarity as the toner polarity by a high voltage power source 8*b*. In any of these discharger devices, the grid 6 is connected to a bias source 7*a* for applying a bias voltage which is variable to the positive and the negative including zero potential. The other conditions are similar to the cases of FIGS. 3, 8 and 9, respectively.

This embodiment is characterized in that it uses the pre-transfer corona discharger of the above-described construction to form a promoting electric field and a suppressing electric field of corona ion between the surface potential of the photosensitive member and the control grid and change part of the toner on the photosensitive member to the opposite polarity, thereby selectively reproducing part of the image.

Brief description will now be made of the action of the control grid when the pre-transfer corona discharger of FIG. 12 having AC applied thereto is applied to the Carlson electrophotography. A latent image having a dark portion surface potential VD = +800 V and a light portion surface potential VL(V) is formed on the photosensitive member. The surface potentials after the development are +700 (V) and VL(V), respectively. A voltage VB between the surface potentials of the light portion L and the dark portion D of the photosensitive member after developed is applied to the control grid. Here, VB is set, for example, to a potential substantially equal to or greater than the potential of the background (intermediate density DL) of the image.

Figure 14:
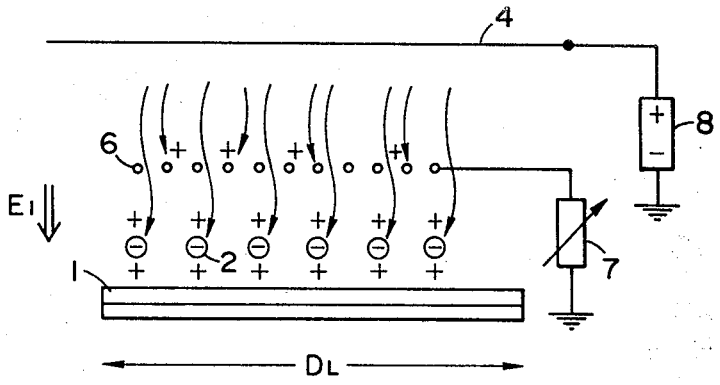
FIGS. 14 to 17 illustrate the action of the pretransfer corona discharger.

FIG. 14 shows the condition, during positive corona discharge, of the intermediate density portion DL having a potential lower than the bias voltage VB. Designated by 2 is toner charged to the negative polarity. A bias VB(V) is applied to the control grid 6. The positive corona ions generated at the discharge electrode 4 reach the neighborhood of the control grid 6, whereafter they reach the surface of the photosensitive member 1 along a promoting electric field $E_1 = VB - VDL$(V/mm) formed between the control grid 6 and the photosensitive member 1, thereby changing the toner 2 to the positive polarity. This charging is continued until the surface potential of the photosensitive member becomes VB(V), whereby the toner is sufficiently changed to the positive polarity.

Figure 15:
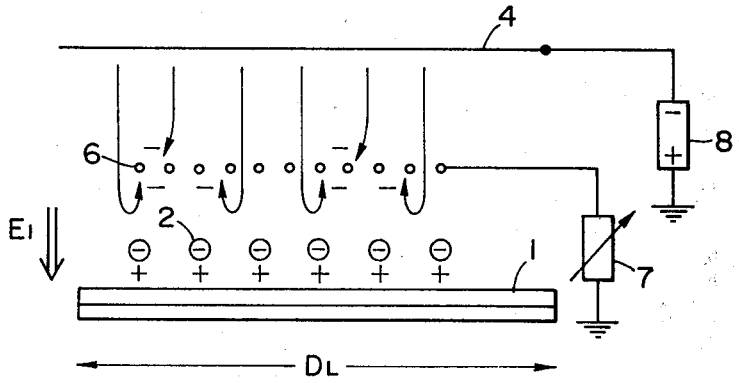

FIG. 15 shows the condition, during negative corona discharge, of the intermediate density portion DL having a potential lower than the bias voltage VB. The negative corona ions generated at the discharge electrode 4 reach the neighborhood of the control grid 6, but cannot reach the photosensitive member due to a suppressing electric field $E_1$ formed between the control grid 6 and the photosensitive member 1 and are caught by the control grid. Thus, the toner adhering to the photosensitive member is never charged to the negative polarity.

Figure 16:
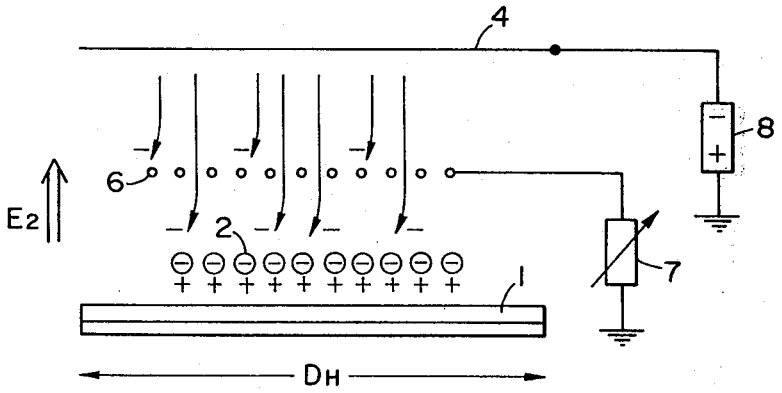

FIG. 16 shows the condition, during negative corona discharge, of the dark portion $D_H$ having a potential higher than the bias voltage VB. A bias VB(V) is applied to the control grid 6. The negative corona ions generated at the discharge electrode 4 reach the neighborhood of the control grid 6, whereafter they reach the surface of the photosensitive member along a promoting electric field $E_2 = 700 - VB$ (V/mm) formed between the control grid and the photosensitive member, thereby charging the toner in this portion more to the negative polarity. As a result, the toner is sufficiently charged to the negative polarity.

Figure 17:
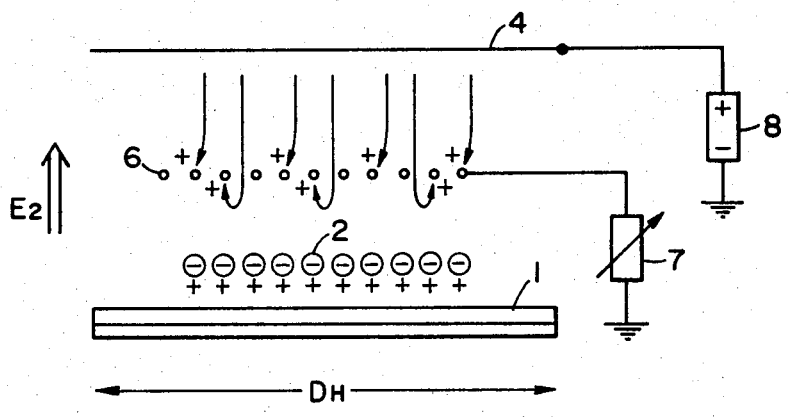

FIG. 17 shows the condition, during positive corona discharge, of the dark portion $D_H$ having a potential higher than the bias voltage VB. The positive corona ions generated at the discharge electrode 4 reach the neighborhood of the control grid 6, but cannot reach the photosensitive member due to a suppressing electric field $E_2$ formed between the control grid 6 and the photosensitive member 1 and are caught by the control grid. Thus, the toner adhering to the photosensitive member is never changed to the positive polarity.

In this manner, it becomes possible for the surface potential of the photosensitive member to change the polarity of only the toner below the control grid bias VB to the opposite polarity.

The toner pattern positively and negatively formed on the photosensitive member is then delivered to the transfer station, where it is subjected to transfer corona discharge of about +6.5 KV of the same polarity as the latent image charge through transfer paper. Only the toner having minus (−) charge greater than VB is transferred onto the transfer paper separated from the photosensitive member.

Figure 18:
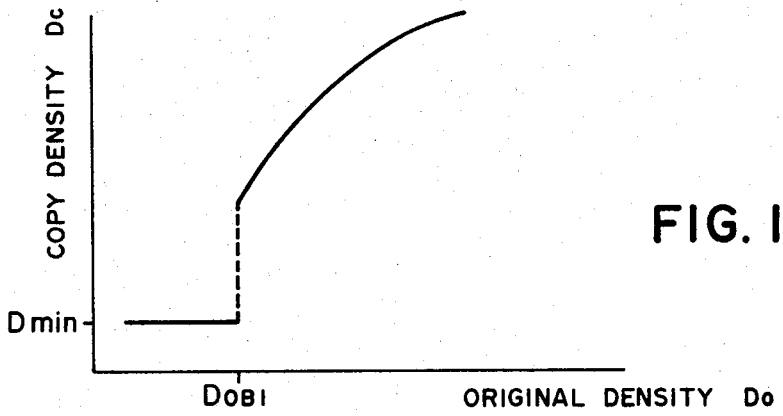
FIGS. 18 and 19 are graphs showing the image characteristic curves when only the image area having a density lower than any desired intermediate density has been erased.
Figure 19:
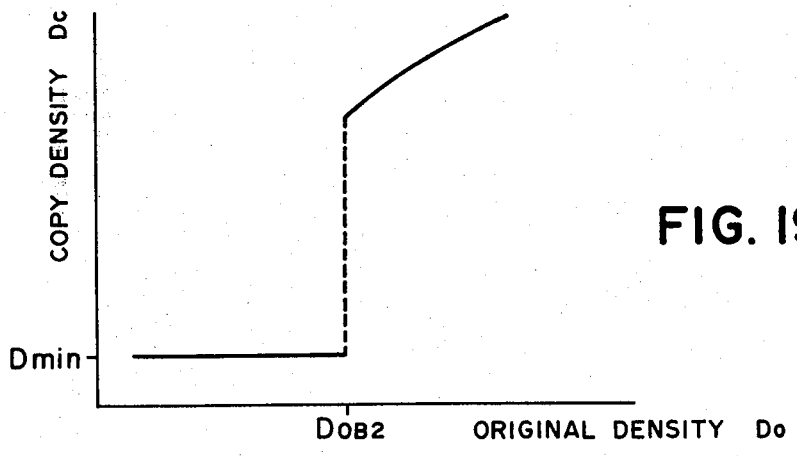

FIGS. 18 and 19 show the characteristic curves of reproduced images. The abscissa represents the original density $D_O$, and the ordinate represents the copy density $D_C$. Dmin represents the transfer paper density.

The characteristic curve indicated by solid line in FIG. 18 shows that the copy density of the density portion lower than the original density $D_{OB1}$ is Dmin. This shows that since the toner adhering to the surface portion of the photosensitive member having a surface potential lower than the control grid bias voltage VB of the pre-transfer corona discharger has been changed to the positive polarity, transfer does not take place in the corona discharge of the positive polarity.

Likewise, the characteristic curve indicated by solid line in FIG. 19 shows that when the bias voltage of the control grid has been varied from VB to VB', the toner in the portion having an original density $D_{OB2}$ or less is not transferred but remains on the photosensitive member.

In the description of the actions of FIGS. 14–17, an example using a pre-transfer corona discharger having applied thereto the AC high voltage of FIG. 12 has been shown, but even when positive and negative corona discharges are individually imparted as shown in FIG. 13, there may be obtained the same effect as that obtained in the case of AC. Further, a similar effect may be obtained even by applying a voltage opposite in polarity to the toner as shown in FIG. 11 and changing to the opposite polarity the toner layer on the surface portion having a surface potential lower than the bias voltage VB of the control grid (see FIGS. 14 and 17).

In this embodiment, as described above, a control grid is provided in the pre-transfer corona discharger, and a high voltage opposite in polarity to the toner, or an AC high voltage, or a positive high voltage and a negative high voltage are individually applied to the corona discharge electrode, and a bias voltage between the dark portion potential and the light portion potential of the photosensitive member is applied to the control grid and this bias voltage is varied and therefore, when image transfer is subsequently effected by a transfer device of the same polarity as the latent image charge, it is possible to erase only the image area having a density lower than any desired intermediate density. Especially, where the color of the background of the original is deep and this causes fog, the present embodiment is very effective to eliminate such fog. Thus, according to the present embodiment, under any conditions, it is possible to carry out a very characteristic image processing without the maximum image density being varied.

It is also possible to reproduce only the image portion having a density lower than any desired density by using the pre-transfer corona discharger of FIGS. 11–13 similar to the above-described embodiment. As described above, it is possible to change the toner polarity of the intermediate density portion DL having a potential lower than the bias voltage VB to the opposite polarity by using the device of FIGS. 11–13. Accordingly, the toner patterns positively and negatively formed on the photosensitive member are delivered to the transfer station, where transfer corona discharge of about 6.5 KV of the opposite polarity to the latent image charge, i.e. the minus polarity in this embodiment, is imparted to the back side of transfer paper. Thereupon, only the toner having plus (+) charge less than VB is transferred onto the transfer paper separated from the photosensitive member.

Figure 20:
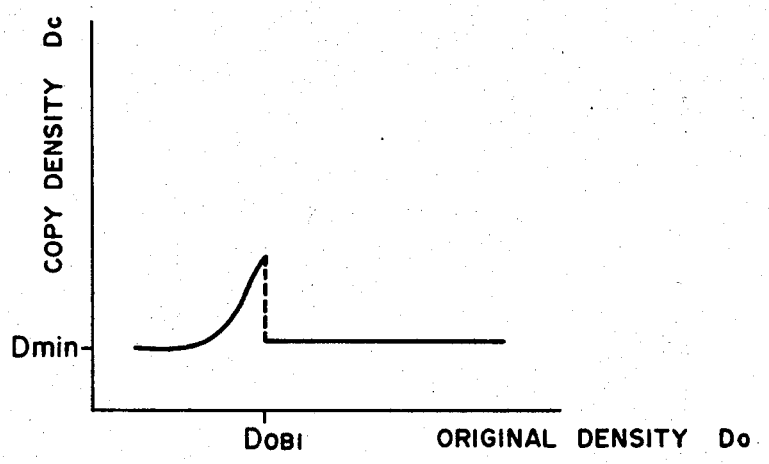
FIGS. 20 and 21 are graphs showing the image characteristic curves when only the image area having a density lower than any desired intermediate density has been reproduced.
Figure 21:
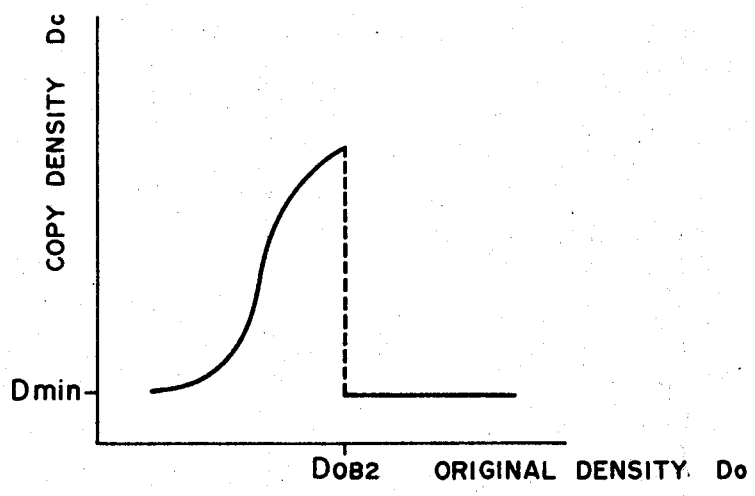

FIGS. 20 and 21 show the characteristic curves of reproduced images. The abscissa represents the original density $D_O$, and the ordinate represents the copy density $D_C$. Dmin represents the transfer paper density.

The characteristic curve indicated by solid line in FIG. 20 shows that the copy density of the portion having a density higher than the original density $D_{OB1}$ is Dmin. This shows that since only the toner adhering to the surface portion of the photosensitive member having a potential lower than the control grid bias voltage VB of the pre-transfer corona discharger has been changed to the positive polarity, only this plus (+) toner is transferred by the corona discharge of the negative polarity and the minus (−) toner adhering to the surface portion of the photosensitive member having a potential greater than VB is not transferred.

Likewise, the characteristic curve indicated by solid line in FIG. 21 shows that when the bias voltage of the control grid has been varied from VB to VB', the toner on the portion having a density greater than the original density $D_{OB2}$ is not transferred but remains on the photosensitive member.

Thus, in this embodiment, a control grid is provided in the pre-transfer corona discharger, and a high voltage opposite in polarity to the toner, or an AC high voltage, or a positive high voltage and a negative high voltage are individually applied to the corona discharge electrode, and a bias voltage between the dark portion potential and the light portion potential of the photosensitive member is applied to the control grid and this bias voltage is varied, and then image transfer is effected by a transfer device opposite in polarity to the latent image charge and therefore, it has become possible to reproduce only the image area having a density lower than any desired intermediate density. Thus, according to this embodiment of the present invention, it is possible to carry out a very characteristic image processing.

Figure 22:
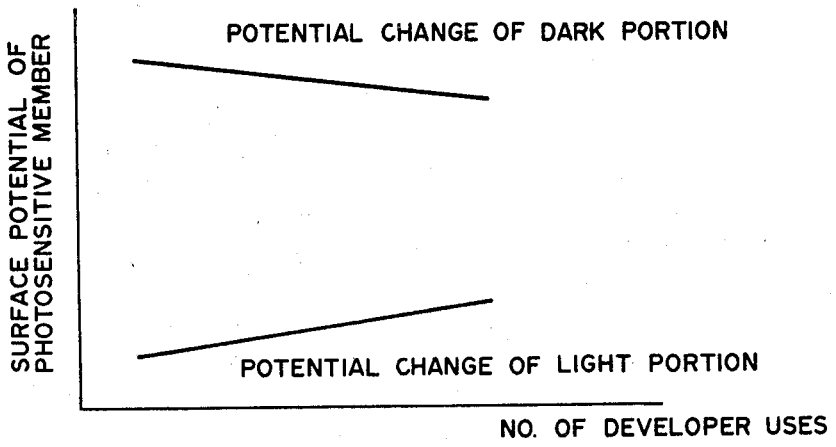
FIG. 22 is a graph showing the variation in surface potential of the photosensitive member by the frequency of use of the photosensitive member.
Figure 23:
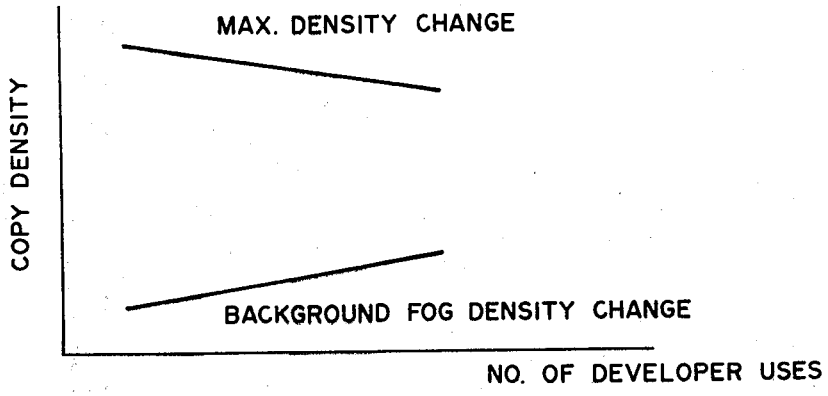
FIG. 23 is a graph showing the variation in copy density by the frequency of use of the developer.

Now, generally, a photosensitive member and developer used in an electrophotographic apparatus have their characteristics varied by repetition of charging, exposure and development. For example, in a photosensitive member of Se, $ZnO_2$ or the like, the residual potential of the photosensitive member increases after the charging and exposure have been repeated a number of times, and even after sufficiently exposed to an original image, the potential of the light portion of the photosensitive member does not fully drop as shown in FIG. 22, thus resulting in production of a stained copy having the so-called background fog which is the increased toner adhering to the background of the image.

Also, after development has been repeated a number of times, the two-component developer comprising magnetic carrier and toner has its electrical resistance value increased and its electrode effect is weakended to readily cause fog. Further, the fine powder toner and non-charged toner in the developer are increased and therefore, as the use of the developer is repeated, the resultant copies become stained by much toner adhering to the background of the image (FIG. 22). For example, when fresh developer is used, the image density is as high as about 1.4 and there occurs little fog of the white ground, but when developer after 30,000 to 50,000 copies have been produced is used, the image density is reduced to 1.0 and the resultant copy images have remarkable fog on the white ground. This is attributable to the degeneration of developer, namely, a phenomenon called the deterioration of developer.

Usually, the average particle diameter of the toner in developer used for a long time tends to become smaller than it initially was. The reason is that during development, toner of 7–15μ is liable to selectively adhere and as the developer is used for a long time, the rate of toner particles of 3–5μ is increased in the developer. The developer whose particle diameter has become so smaller has its electrical resistance increased and the electrode effect by the developer itself is decreased, so that the toner adhering to the dark portion of the photosensitive drum is decreased.

Also, the developer used for a long time is decreased in transfer efficiency. One reason therefor is that, in case of two-component developer, fine powder toner covers the surface of the carrier in the developer, whereby the contact between other toner and carrier becomes poor and the frictional charge amount of the toner becomes irregular and this results in transfer irregularity.

Further, the developer used for a long time is reduced in toner transfer efficiency. When fresh developer is used, 80–90% of the toner on the photosensitive drum is transferred to transfer medium, whereas the transfer efficiency of the developer used for a long time is reduced to the order of 60–70%. This is attributable to the aforementioned irregularity of the toner charge amount and to the fact that the developed toner tends to become finer and the force between the photosensitive drum and the molecules of the toner is increased.

Accordingly, the next embodiment of the present invention eliminates the above-noted disadvantage peculiar to the prior art and provides a device for ensuring images free of fog to be obtained. In the embodiment hereinafter described, the bias voltage value of the control grid of the pre-transfer corona discharger is gradually increased in accordance with the frequency of use of the photosensitive member or the developer, whereby the charge polarity of the increased toner adhering to the light portion of the photosensitive member due to the increased residual potential of the photosensitive member or the increased toner adhering to the light portion of the photosensitive member due to the increased electrical resistance of the developer is changed to the opposite polarity, thus preventing such toner from being transferred to transfer medium. By this, obtainment of images free of fog is ensured.

The pre-transfer corona discharger device used in this embodiment is that shown in FIGS. 11, 12 or 13. In the present embodiment, by using the pre-transfer corona discharger of the above-described construction, a promoting electric field and a suppressing electric field of corona ion are formed between the surface potential of the photosensitive member and the control grid, and the fog toner on the photosensitive member is changed to the opposite polarity to thereby prevent such toner from being transferred to transfer medium. The basic operational principle of these pre-transfer corona dischargers is as illustrated in FIGS. 4 to 7. To prevent fog from being created on the background by this principle, copies may be produced by making the grid voltage of the pre-transfer charger higher than the light portion potential of the photosensitive member.

Figure 24:
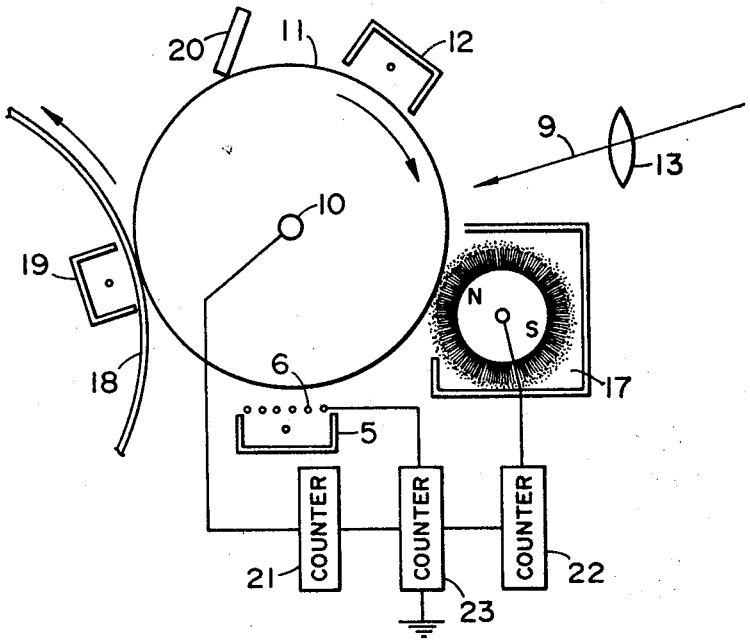
FIG. 24 is a schematic view of an electrophotographic apparatus to which the present invention is applied.

FIG. 24 is a schematic view of an electrophotographic apparatus to which the pre-transfer corona discharger of the present invention is applied. In FIG. 24, members identical in function to those of FIG. 2 are given identical reference characters. Reference numeral 9 designates an optical image exposure light, and reference numeral 10 denotes the shaft of the drum. In this apparatus, the number of revolutions of the drum or the sleeve roller is counted by a photosensitive member use frequency counter 21 or a developer use frequency counter 22. The output value of a bias source 23 is gradually changed by the number of revolutions counted by both or one of these counters, thereby varying the potential of the control grid 6 of the pre-transfer corona discharger 5. Even if the frequency of use of the photosensitive member or the developer is increased and the light portion potential or the fog density is increased, the bias potential of the control grid is also increased in accordance with said increase and a promoting electric field of corona discharge opposite in polarity to the charged toner always acts between the control grid and the light portion of the photosensitive member, so that the fog toner is changed in polarity and is never transferred to transfer paper. Accordingly, copy images free of fog can be obtained and moreover, the maximum density of the image is not varied.

A method of applying to the developing device a bias higher than the surface potential of the light portion of the photosensitive member to eliminate fog is well-known. A method using this method to increase the bias voltage in accordance, for example, with the rise of the residual potential of the photosensitive member or with the frequency of use of the developer to thereby suppress fog would be conceivable, whereas such method has a disadvantage that the apparent dark portion potential of the photosensitive member is reduced and therefore, the maximum density of the image is also reduced gradually. According to the present invention, the elimination of fog can be achieved without such disadvantage.

In this embodiment, the bias voltage to the control grid of the pre-transfer corona discharger is varied in accordance with the frequency of use of the photosensitive member or the developer, and only the toner adhering to the area of the photosensitive member having a potential lower than the bias potential is changed to the opposite polarity, thereby preventing transfer and therefore, images free of fog can be obtained without varying the maximum density of the image.

Figure 25:
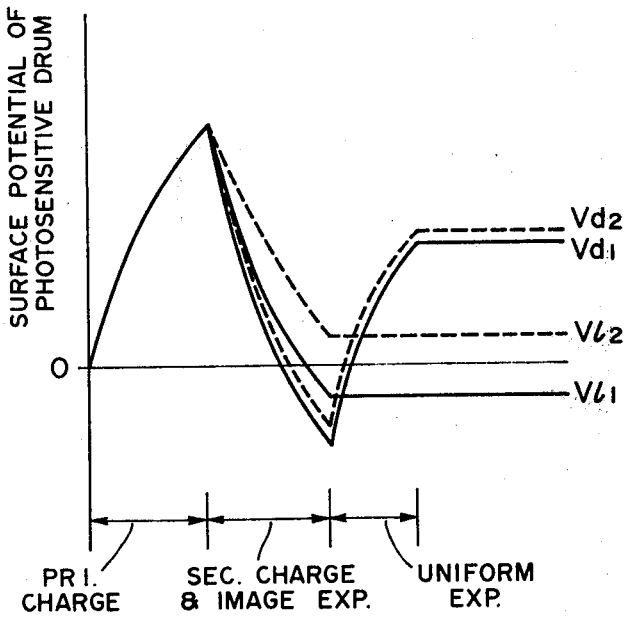
FIG. 25 is a graph showing the variation in surface potential of the photosensitive member.

While the present invention has so far been described with respect to the Carlson process using a two-layer photosensitive member comprising a photosensitive layer provided on an electrically conductive substrate, the present invention is also applicable to other electrophotographic processes. For example, an electrophotographic process described in detail in U.S. Pat. No. 3,666,363 which uses a three-layer photosensitive member using CdS or the like as the photosensitive layer and having an insulating layer on the surface thereof is known. According to this process, a dark portion latent image of about +500 V and a light portion latent image of about −50 V are formed on the surface of the photosensitive member, for example, through the primary charging of the positive polarity, the secondary AC discharging simultaneous with the image exposure, and the uniform exposure. FIG. 25 shows the variations in surface potential of the photosensitive member during such time. In FIG. 25, $Vd_1$ represents the curve of the dark portion potential, and $Vl_1$ represents the curve of the light portion potential.

Incidentally , of the above-described corona discharges, especially the secondary AC corona is unstable for changes in environmental conditions such as temperature, humidity, etc. and when the environment in which it is used is at the order of 30° C. and 80%, the discharging capability is reduced and the curves of the surface potentials of the photosensitive drum are also varied as indicated by broken lines $Vd_2$ (dark portion) and $Vl_2$ (light portion) in FIG. 25. For such potential fluctuations, a method of measuring the latent image potential of the light portion of the photosensitive member and varying the bias voltage of the developing device in accordance with the measured value to thereby prevent fog of the image is known. More specifically, it is a method of measuring the latent image potential of the portion of a standard white plate provided on the fore end portion of an original or applying a predetermined quantity of light corresponding to the quantity of reflected light of the standard white plate during the image exposure, measuring the then latent image potential and applying a bias voltage of a predetermined value to the developing device during the image formation to thereby prevent fog. For example, the potential variations of the light portion and dark portion latent images are as shown in Table 1 below.

TABLE 1

| Environment | 20° C., 40% | 30° C., 80% |
|---|---|---|
| Dark portion potential Vd | +500V | +520V |
| Light portion potential Vl | −50V | +50V |
| Developing device bias voltage | 0V | +100V |

As seen from this Table, the light portion potential Vl changes from −50 V to +50 V, but since a bias voltage of +100 V is applied to the developing device, the apparent light portion potential (light portion potential-developing device bias voltage) is maintained at 50−100=−50 V, thus producing no fog. However, the apparent dark portion potential (dark portion potential-developing device bias voltage) is reduced to 520−100=420 V and thus, the image density is reduced.

The next embodiment of the present invention overcomes the above-noted disadvantage and provides a novel image stabilizing method which prevents fog and yet causes no reduction in the image density. In this embodiment, a pre-transfer corona discharger having a control grid is provided between the developing area and the transfer area, the light portion surface potential of the photosensitive member is measured, and a bias voltage of the measured value plus a predetermined value is applied to the control grid, whereby corona discharge is applied to the photosensitive member by the pre-transfer corona discharger. This embodiment will hereinafter be described in detail with reference to the drawings.

The pre-transfer corona discharger device used in this embodiment is that shown in FIGS. 11, 12 or 13. Again in the present embodiment, by using the pre-transfer corona discharger of the above-described construction, a promoting electric field and a suppressing electric field of corona ion are formed between the surface potential of the photosensitive member and the control grid and the fog toner on the photosensitive member is changed to the opposite polarity to thereby prevent such toner from being transferred to transfer medium. The basic operational principle of these pre-transfer corona dischargers is as shown in FIGS. 4 to 7.

Figure 26:
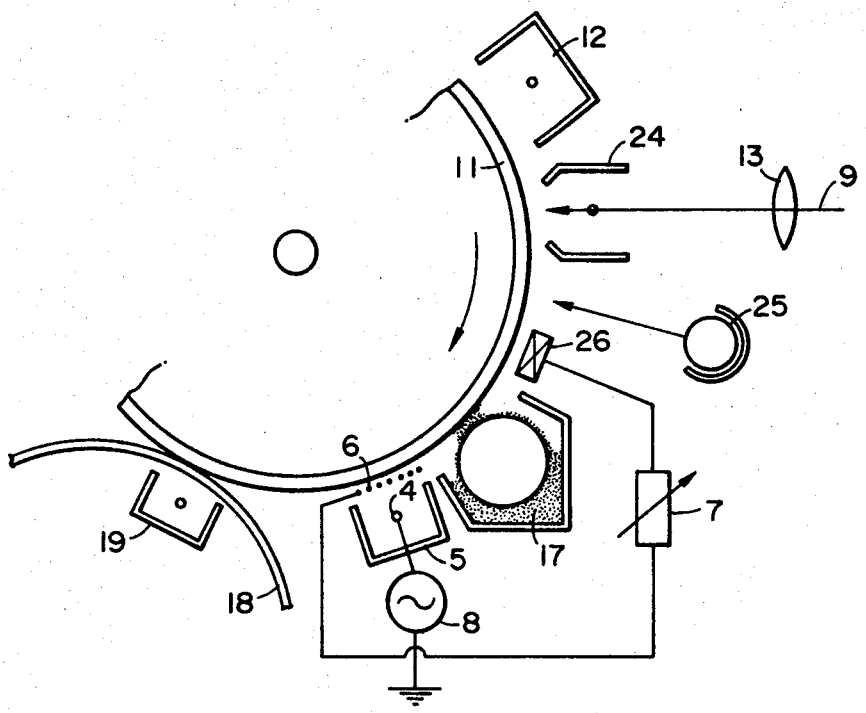
FIG. 26 is a schematic view of an electrophotographic apparatus to which the present invention is applied.

FIG. 26 is a partial schematic view of an electrophotographic apparatus to which the present invention is applied. In FIG. 26, members identical in function to those of FIG. 24 are given identical reference characters. The photosensitive drum 11 has a three-layer photosensitive member on the surface thereof and is rotated in the direction of arrow. In FIG. 26, reference numeral 12 designates a primary charger, reference numeral 24 denotes an exposure and discharging device, reference numeral 25 designates a whole surface exposure lamp, and reference numeral 26 denotes a photosensitive member surface potential measuring device disposed in the light beam from the whole surface exposure lamp 25 and it measures the potential of the light portion of the photosensitive member. To measure the light portion potential of the photosensitive member surface, use may be made of the method using the standard white plates as previously described, or the method of applying a predetermined quantity of light during the image exposure and measuring the then light portion surface potential. The output value of the grid bias surface 7 is adjusted in accordance with the measured value of the surface potentiometer 26, whereby the grid bias potential of the pre-transfer charger is determined.

Figure 27:
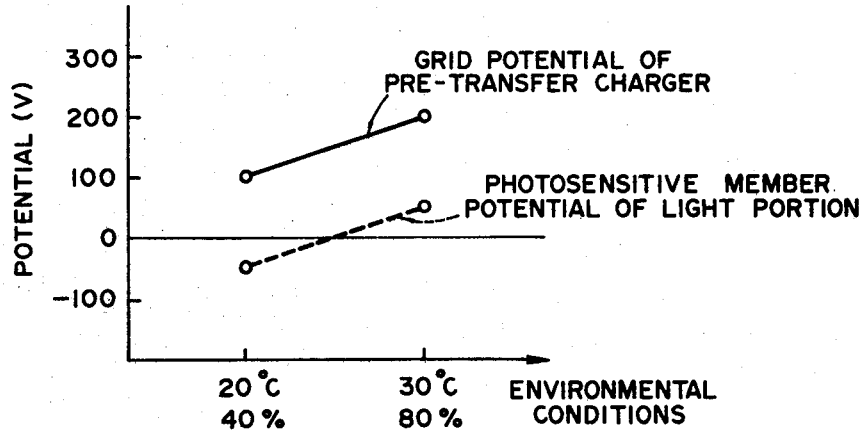
FIG. 27 is a graph showing the variation in the grid bias potential by the changes in environmental conditions.

FIG. 27 is a graph showing the change in grid bias potential resulting from change in environmental conditions, and a voltage of the light portion potential plus 150−200 V is applied to the gird. In case of 20° C. and 40%, a voltage of about 100 V is applied, and in case of 30° C. and 80%, a voltage of 200 V is applied, whereby fog can be prevented without reducing the image density.

In this embodiment, the bias voltage to the control grid of the pre-transfer corona discharger is varied in accordance with the variation in the light portion surface potential of the photosensitive member and only the toner adhering to the area of the photosensitive member having a potential lower than the bias potential is changed to the opposite polarity to thereby prevent transfer of such toner, and in carrying out this embodiment, the developing device bias and the grid bias may preferably be used in combination in such a manner that a bias voltage is applied to the developing device to such a degree as not to reduce the image density, to thereby decrease the fog of the toner on the photosensitive member, and then the toner is prevented from being transferred by the method of the present invention.

Another embodiment of the present invention will be described in detail. When copies are to be produced by the use of a copying apparatus, it is the common practice to adjust the aperture of the lens and the voltage applied to the illuminating lamp by means of an image adjusting dial to thereby change the exposure amount to the photosensitive member. Usually, by setting the image adjusting dial having dial positions (1)–(9) to the vicinity of the middle position (5), there are obtained copies of high image contrast which are free of fog.

In the case of a thin-character original in which characters are written by the use of a pencil of the order of H or 2H, the density difference between the background portion and the line portion such as the characters or the like is small, so that it is difficult to form on the photosensitive member a latent image having a sufficient potential difference. For this reason, usually, the adjustment dial is turned toward the position (9) to reduce the image exposure amount so that the line portion is darkly reproduced. However, this is liable to cause the background portion to be fogged. Also, for such a thin-character original, the conventional pre-transfer charger acts to negate not only the fog but also the line portion, and this is very inconvenient.

In this embodiment of the present invention, the bias voltage value of the control grid of the pre-transfer corona discharger is gradually varied in accordance with the variation of the image adjusting means to change to the opposite polarity the charge polarity of the increased toner adhering to the light portion of the photosensitive member due to the rise of the residual potential of the photosensitive member or the increased toner adhering to the light portion of the photosensitive member due to the rise of the electrical resistance of the developer, thereby preventing such toner from being transferred to transfer medium. Thus, it is possible to ensure fog-free clear copy images to be obtained from thin-character originals.

Figure 28:
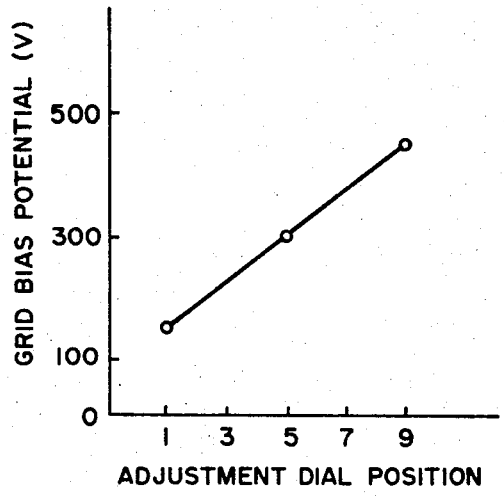
FIG. 28 is a graph showing the relation between the image adjusting dial and the grid bias voltage.

FIG. 28 shows the relation between the adjustment dial and the bias voltage when the voltage applied to the grid has been controlled in accordance with the image adjusting dial. In the following description, a method of effecting the image adjustment by changing the exposure amount will be shown, whereas the present invention is not restricted to such method but is applicable to the well-known image adjusting method such as, for example, the method of changing the charging potential in accordance with the adjustment dial, or the method of changing the developing bias potential.

The position (5) of the adjustment dial is a position in which an original written on an ordinary white ground can be reproduced without fog, and a voltage of about 300 V between the dark portion potential and the light portion potential after development is applied to the control grid. When the dial is at the position (9), a voltage of about 400 V is applied to the grid. The dial position (9) is a position in which originals having a colored background are copied, and by increasing the grid bias, it is possible to obtain copies of high contrast having no ground stain. Also, when the dial is at the position (1), the grid bias is reduced to 200 V. By this, even thin-character originals can be clearly copied. In some cases, the grid bias may be below the light portion potential. The dial position (1) is a position in which, when a thin-character original is copied, the thin character portion is sufficiently darkly reproduced with the background somewhat fogged. Since the image contrast between the original background and the thin character portion is low, little amount of toner adheres to the photosensitive member. Therefore, by reducing the control grid voltage and causing a strong transfer promoting action to take place, all of the toner on the photosensitive member can be transferred to obtain a copy in which the thin character portion is legible.

Figure 29:
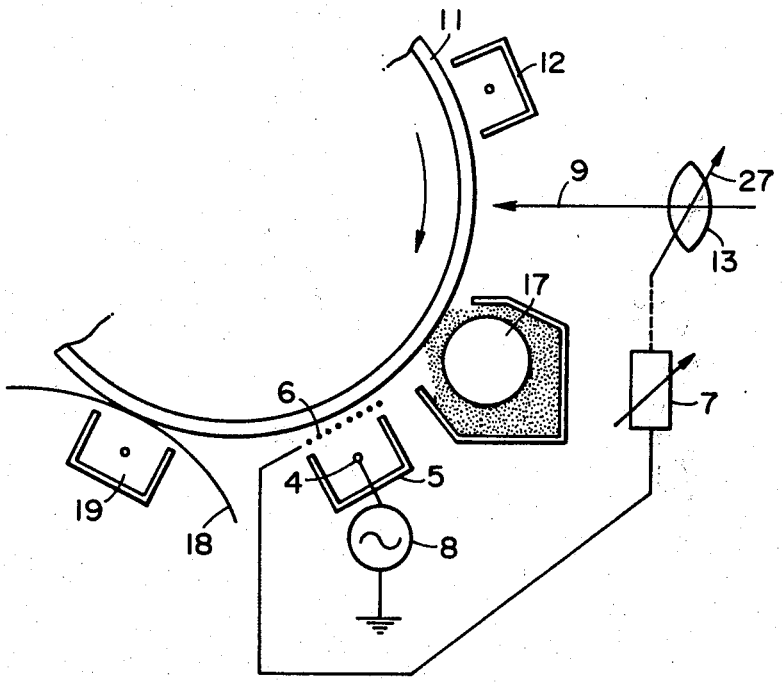
FIG. 29 is a schematic view of an electrophotographic apparatus to which the present invention is applied.

FIG. 29 is a schematic view of an electrophotographic apparatus to which the present invention is applied. In FIG. 29, members given reference characters similar to those of FIG. 24 perform similar functions. The pre-transfer corona discharger 5 may be the one shown in FIGS. 11, 12 or 13. The operation thereof is as already described. In this apparatus, in accordance with the position of an image adjusting dial 27 (which, in this case, is operatively associated with the aperture of a lens 13), the bias voltage to the control grid 6 of the pre-transfer charger 5 is varied as shown in FIG. 28 by varying the output of the bias source 7, whereby ensuring the formation of legible images to be achieved.

Now, a construction is also possible in which uniform light application takes place substantially simultaneously with the discharge of any of the above-described pre-transfer corona dischargers. In that case, the pre-transfer discharger may be of the same construction as the simultaneous image exposure and discharger 24 shown in FIG. 26. The quantity of the uniform light should be sufficient to make conductive the portion of the photosensitive member having no toner, namely, the photosensitive layer portion of the image light portion, and more specifically, should be ½ of the image exposure amount or equivalent thereto. Since no corona charge is accumulated on the surface of the photosensitive member which has been made conductive, the potential of the surface of the photosensitive member is maintained at 200 V and the potential of the photosensitive member surface does not rise to weaken the promoting electric field between the photosensitive member surface and the control grid but such promoting electric field continues to be maintained sufficiently great, so that a sufficient charge of the opposite polarity to prevent fog is imparted to the toner. In the image dark portion, the quantity of uniform light is attenuated to 1/10 to 1/several $10_S$ by being intercepted by the toner layer and therefore, the influence imparted thereby to the charge of the photosensitive member surface is small.

In the foregoing description of the present invention, an example has been shown in which an electrostatic latent image of the positive polarity is formed on the photosensitive member and is developed by toner having a charge of the negative polarity, but of course, the present invention holds good even if the combination of the polarities is reversed. Also, in FIGS. 8 and 13, an example of the pre-transfer corona discharger which comprises two corona discharging portions having the plus and the minus polarity has been shown, but even if the pulse discharger and the minus discharger are constructed separately from each other, the same operational effect as that of the above-described embodiment may be obtained. The image bearing member in the present invention is a general term for the members capable of bearing an electrostatic latent image on the surface thereof, such as other photosensitive members than the photosensitive member described in the foregoing description, insulating drums, etc. As an example of the insulating drum, mention may be made of the insulating drum as described in U.S. Pat. No. 4,046,466 which is used to form a secondary latent image through ion modulation by using a primary latent image formed on a screen-like photosensitive member. The present invention is applicable not only to copying machines but also to apparatuses such as laser beam printers using the electrophotographic method.

What I claim is:

1. An electrophotographic apparatus having:

an image bearing member capable of bearing an electrostatic latent image on the surface thereof;

latent image formation means for forming an electrostatic latent image on said image bearing member;

developing means for developing the electrostatic latent image;

means for transferring the developed image to a transfer medium;

a pre-transfer corona discharger device provided in an area between said developing means and said transfer means;

a grid disposed in the discharger opening portion of said pre-transfer corona discharger device which faces said image bearing member; and means for applying a bias potential to said grid, said bias potential having a value which lies between the dark portion potential and the light portion potential of the electrostatic latent image on said image bearing member.

2. An apparatus according to claim 1, wherein an AC voltage is applied to the discharge electrode of said pre-transfer corona discharger device.

3. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device, provided in an area between a developing station and a transfer station, said discharger device including a corona discharger for applying electric charge of a polarity opposite to that of the tone on said image bearing member;

a grid disposed in the discharge opening portion of said pre-transfer corona discharger device which faces said image bearing member to form electric fields which are directed oppositely at the dark area and the light area so as to apply, at the light area, charge of a polarity opposite to that of the toner; and a bias source for applying a bias voltage to said grid, the output of said bias source being variable and having a potential value which lies between the dark portion potential and the light portion potential of the electrostatic latent image on said image bearing member.

4. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device provided in an area between a developing station and a transfer station, said discharger device including a corona discharger for applying electric charge of a polarity the same as that of toner on said image bearing member;

a grid disposed in the discharge opening portion of said pre-transfer corona discharger device which faces said image bearing member to form electric fields which are directed oppositely at the dark area and the light area so as to apply, at the dark area, charge of a polarity the same as that of the toner; and a bias source for applying a bias voltage to said grid, the output of said bias source being variable and having a potential value which lies between the dark portion potential and the light portion potential of the electrostatic latent image on said image bearing member.

5. An apparatus according to any one of claims 1, 2, 3 or 4, wherein said image bearing member is a photosensitive member, and uniform light is applied to said photosensitive member substantially simultaneously with said pre-transfer corona discharge.

6. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a first pre-transfer corona discharger device provided in an area between said developing means and said transfer means and to which a voltage of the same polarity as the charge polarity of the toner is applied;

a second pre-transfer corona discharger device to which a voltage of the opposite polarity to the charge polarity of the toner is applied;

said first and second pre-transfer corona discharger devices having a common grid disposed in the discharge opening portions thereof which face said image bearing member; and means for applying a bias potential to said grid, said bias potential having a value which lies between the dark portion potential and the light portion potential of the electrostatic latent image on said image bearing member.

7. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device provided in an area between a developing station and a transfer station, said discharger device including discharge means for applying corona of opposite polarities;

a grid disposed in the discharge opening portion of said pre-transfer corona discharger device which faces said image bearing member; and a bias source for applying a bias voltage to said grid, the output of said bias source being variable and having a potential between the dark portion potential and the light portion potential of the electrostatic latent image on said image bearing member, wherein electric fields are formed which are directed oppositely at the dark area and the light area, so that the electric field at the light area is effective to apply charge of a polarity opposite to that of the toner, while the electric field at the dark area is effective to apply charge of a polarity the same as that of the toner.

8. An apparatus according to claim 7, wherein when image transfer is effected by transfer means to which a voltage of the opposite polarity to the charge polarity of the latent image is applied, the grid bias voltage by said variable bias source is adjusted to reproduce only the image portion having a density lower than any desired density.

9. An apparatus according to claim 7, wherein when image transfer is effected by transfer means to which a voltage of the same polarity as the charge polarity of the latent image is applied, the grid bias voltage by said variable bias source is adjusted to erase the image portion having a density lower than any desired density.

10. An apparatus according to claim 7, wherein a potential between the dark portion potential and the light portion potential of the electrostatic latent image on said image bearing member is applied as a bias potential to said grid.

11. An electrophotographic apparatus having:

a photosensitive member bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device provided in an area between a developing station and a transfer station, said discharger device including discharge means for applying corona of opposite polarities;

a grid disposed in the discharge opening portion of said pre-transfer corona discharger device which faces said image bearing member;

a bias source for applying a bias voltage to said grid, the output of said bias source being variable and having a potential between the dark portion potential and the light portion potential of the electrostatic latent image on said image bearing member, wherein electric fields are formed which are directed oppositely at the dark area and the light area, so that the electric field at the light area is effective to apply charge of a polarity opposite to that of the toner, while the electric field at the dark area is effective to apply charge of a polarity the same as that of the toner; and means for measuring the frequency of use of said photosensitive member, and for varying said grid bias voltage in accordance with said measured frequency of use to prevent the background of the image from being stained by toner.

12. An electrophotographic apparatus having:

an image bearing member capable of bearing an electrostatic latent image on the surface thereof;

latent image formation means for forming an electrostatic latent image on said image bearing member;

developing means for developing the electrostatic latent image;

means for transferring the developed image to a transfer medium;

a pre-transfer corona discharger device provided in an area between a developing station and a transfer station;

a grid disposed in the discharge opening portion of said pre-transfer corona discharger device which faces said image bearing member;

a bias source for applying a bias voltage to said grid, the output of said bias source being variable and having a potential between the dark portion potential and the light portion potential of the electrostatic latent image on said image bearing member; and means for measuring the degree of use of developer;

said grid bias voltage being varied in accordance with said measured degree of use to prevent the background of the image from being stained by toner.

13. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device provided in an area between a developing station and a transfer station, said discharger device including discharge means for applying corona of opposite polarities;

a grid disposed in the discharge opening portion of said pre-transfer corona discharger device which faces said image bearing member;

a bias source for applying a bias voltage to said grid, the output of said bias source being variable and having a potential between the dark portion potential and the light portion potential of the electrostatic latent image on said image bearing member, wherein electric fields are formed which are directed oppositely at the dark area and the light area, so that the electric field at the light area is effective to apply charge of a polarity opposite to that of the toner, while the electric field at the dark area is effective to apply charge of a polarity the same as that of the toner; and means for measuring the surface potential of said image bearing member and for varying the grid bias voltage in accordance with said measured value.

14. An apparatus according to claim 13, wherein said measuring means measures the light portion surface potential and applies to said grid a bias voltage of the measured value plus a predetermined value.

15. An apparatus according to claim 13, wherein said image bearing member is a photosensitive member having an insulating layer on the surface thereof and said photosensitive member is subjected to primary charging, secondary discharging and simultaneous exposure, and whole surface exposure to form an electrostatic latent image, and wherein said surface potential measuring means is disposed in the light beam of the whole surface exposure.

16. An electrophotographic apparatus having:

an image bearing member capable of bearing an electrostatic latent image on the surface thereof;

latent image formation means for forming an electrostatic latent image on said image bearing member;

developing means for developing the electrostatic latent image with a toner having a predetermined charge polarity;

means for transferring the developed image to a transfer medium;

a pre-transfer corona discharger device provided in an area between a developing station and a transfer station, said discharger device including discharge means for applying corona of opposite polarities;

a grid disposed in the discharge opening portion of said pre-transfer corona discharger device which faces said image bearing member;

a bias source for applying a bias voltage to said grid, the output of said bias source being variable and having a potential between the dark portion potential and the light portion potential of the electrostatic latent image on said image bearing member, wherein electric fields are formed which are directed oppositely at the dark area and the light area, so that the electric field at the light area is effective to apply charge of a polarity opposite to that of the toner, while the electric field at the dark area is effective to apply charge of a polarity the same as that of the toner; and means for adjusting the image density by varying the voltage applied to said grid.

17. An apparatus according to claim 16, wherein the amount of image exposure light is adjusted by said image density adjusting means.

18. An apparatus according to any one of claims 6 to 17, wherein an AC voltage is applied to the discharge electrode of said pre-transfer corona discharger device.

19. An apparatus according to any one of claims 6 to 17, wherein said pre-transfer corona discharger device has a discharging portion to which a voltage of the same polarity as the charge polarity of toner is applied, and a discharging portion to which a voltage of the opposite polarity to the charge polarity of toner is applied.

20. An apparatus according to any one of claims 6 to 17, wherein a voltage of the opposite polarity to the charge polarity of toner is applied to the discharge electrode of said pre-transfer corona discharger device.

21. An apparatus according to any one of claims 6 to 17, wherein a voltage of the same polarity as the charge polarity of toner is applied to the discharge electrode of said pre-transfer corona discharger device.

22. An apparatus according to any one of claims 6 to 17, wherein said image bearing member is a photosensitive member, and uniform light is applied to said photosensitive member substantially simultaneously with said pre-transfer corona discharge.

* * * * *

UNITED STATES PATENT AND TRADEMARK OFFICE

CERTIFICATE OF CORRECTION

PATENT NO. : 4,402,591

DATED : September 6, 1983

INVENTOR(S) : KIMIO NAKAHATA

It is certified that error appears in the above—identified patent and that said Letters Patent is hereby corrected as shown below:

COLUMN 4

Line 8, after "electrostatic" insert --latent--.

COLUMN 6

Line 14, change "ion" to --ions--.

COLUMN 7

Lines 24, 25 and 51, change "developed" to --development--

COLUMN 8

Lines 55, 56 and 62, change "developed" to --development--

COLUMN 9

Line 31, change "only" to --in--.

COLUMN 12

Line 55, change "weakended" to --weakened--.

COLUMN 13

Line 7, delete "so".

UNITED STATES PATENT AND TRADEMARK OFFICE

CERTIFICATE OF CORRECTION

PATENT NO. : 4,402,591

DATED : September 6, 1983

INVENTOR(S) : KIMIO NAKAHATA

It is certified that error appears in the above—identified patent and that said Letters Patent is hereby corrected as shown below:

COLUMN 16

Line 22, change "gird" to --grid--.

COLUMN 18

Line 31, change "pulse" to --plus--.

Signed and Sealed this

*Third* Day of *January 1984*

[SEAL]

*Attest:*

GERALD J. MOSSINGHOFF

*Attesting Officer*

*Commissioner of Patents and Trademarks*